US005913541A

United States Patent [19]

Chen

[11] Patent Number: 5,913,541

[45] Date of Patent: Jun. 22, 1999

[54] FRONT COVER OF A DIARY OR NOTEBOOK

[75] Inventor: Liang-Ji Chen, Tainan, Taiwan

[73] Assignee: Dashern Enterprise Co., Ltd., Tainan, Taiwan

[21] Appl. No.: 09/119,964

[22] Filed: Jul. 21, 1998

[51] Int. Cl.[6] ..... B42D 3/02; B42D 3/08; B42D 3/10

[52] U.S. Cl. ..... 281/37

[58] Field of Search ..... 281/37

[56] References Cited

U.S. PATENT DOCUMENTS 5,634,667 6/1997 Jordan ..... 281/37

*Primary Examiner*—Willmon Fridie, Jr.
*Assistant Examiner*—Mark T. Henderson
*Attorney, Agent, or Firm*—Rosenberg, Klein & Bilker

[57] ABSTRACT

A front cover of a diary or notebook is integrated directly by a patterned cover sheet and paperboards; the cover sheet is divided into a bigger section and a smaller section, and the bigger section is then divided into three equal portions from inward to outward. Two paperboards are respectively adhered to the inward first and second portions. Two overlapping openings are provided in the first paperboard and the first portion. The outward third portion is counter-folded and adhered to the outer surface of the second paperboard. The second paperboard is counter-folded and with its outward margin adhered to the outward margin of the first paperboard. Consequently, a holder is formed for a picture or an ornamental card to be inserted into.

2 Claims, 5 Drawing Sheets

FIG. 3
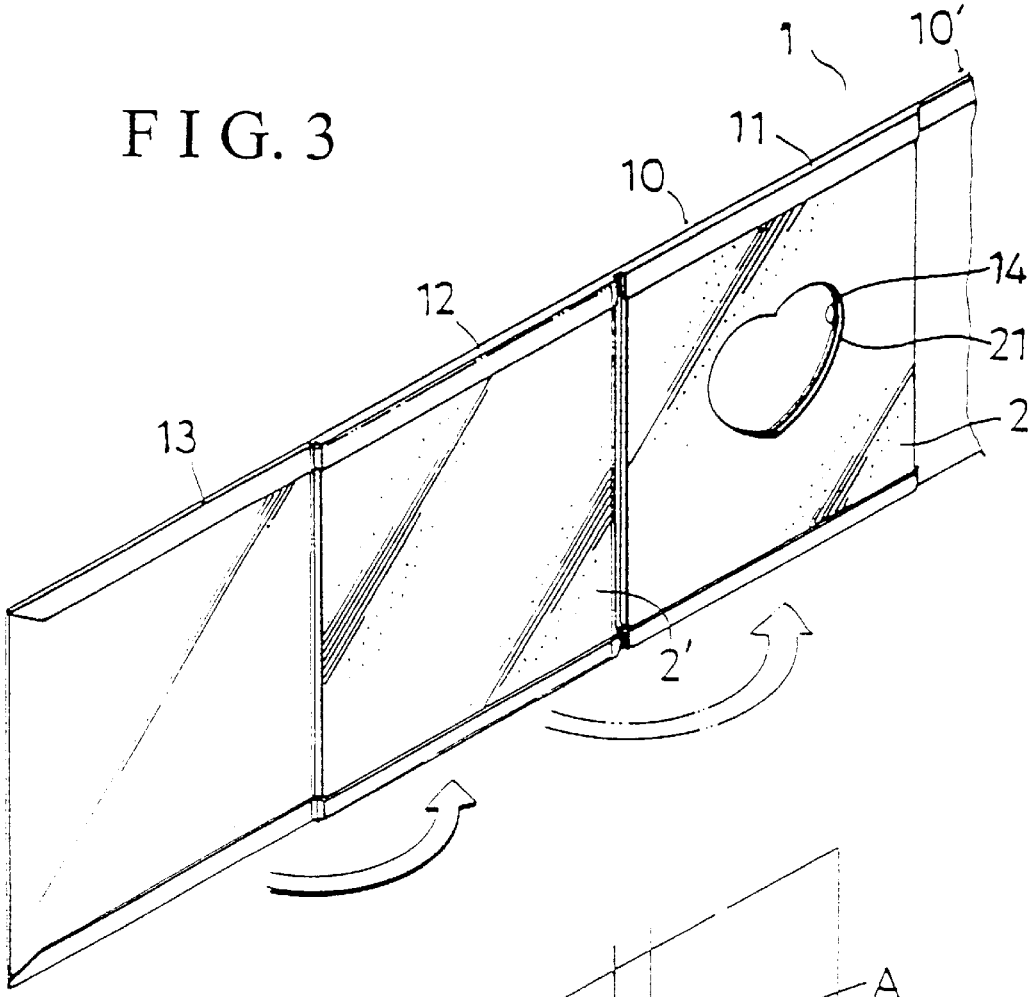
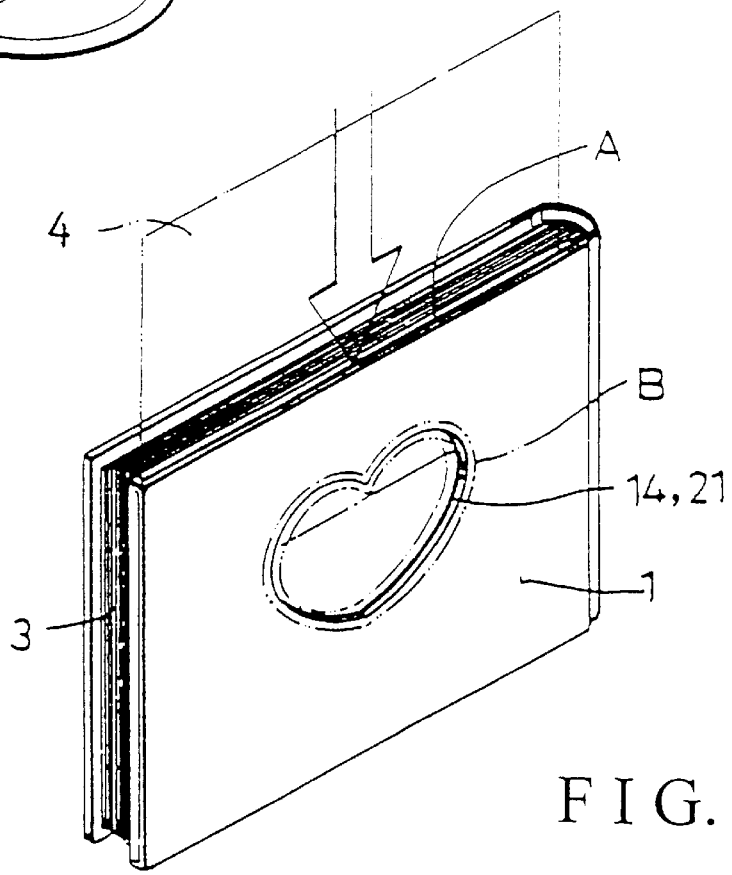
FIG. 5

FRONT COVER OF A DIARY OR NOTEBOOK

BACKGROUND OF THE INVENTION

1. Field of the Invention

This invention relates to a front cover of a diary or notebook, more particularly to a front cover which is provided with a holder for a picture or an ornamental card to be inserted into so as to look solid and lively.

2. Description of the Related Art

A conventional front cover of a diary or notebook shown in FIGS. 6,7 and 8 includes paperboard 01, cover sheet 02 and inner pages 03. Referring to FIG. 6, there is a section 011 provided in the central line of the properly sized paperboard 01 in order for the paperboard 01 easily to be counter-folded and combined to form a holder. An opening 012 is properly provided in one half of paperboard 01, and a lining paper 013 is adhered to the inner surface of the other half of the paperboard 01. An opening 021 is cut according to the shape of the opening 012 in the proper position of patterned cover sheet 02, and some proper-length breaches 022 are outwardly provided in the brim of the opening 021. Referring to FIG. 7, the breaches 022 can be properly cut according to the shape of the opening 021, and thus several dents 023 are formed to be folded inwardly and then applied on glue to cover and adhere the brim of the opening 012 of the paperboard 01. At last, the inner surface of the cover sheet 02 is applied on glue in order to be adhered by the paperboard 01, and a picture holder is formed in one end. In this manner, referring to FIG. 8, the cover and inner pages 03 are composed to be a diary or notebook, and a user can insert a properly sized picture or ornamental card into the holder.

However, the composing manner of the above-mentioned prior art of the front cover is found to be rather troublesome and time-consuming so as to waste labor and cost much. The composing process is complicated, and the product made by the prior art is defective. For example, when being counter-folded, the paperboard must be adhered by an additional lining paper because the paperboard itself is rough, thick and not beautiful. Besides, the lining paper itself without any pattern may be apparently seen from the overlapping opening in the cover sheet and the paperboard before a picture or an ornamental card is inserted into the holder. Consequently, too many composing parts and adherent positions necessary for composing waste time, labor and cost.

SUMMARY OF THE INVENTION

Therefore, an objective of this invention is to provide a front cover of a diary or notebook which is integrated and easily composed so as to save cost, labor and time.

Another objective of this invention is to provide a front cover of a diary or notebook in which an ornamental frame is inlaid to make the front cover look solid and lively.

Accordingly, a front cover of a diary or notebook in the present invention is integrated directly by a patterned cover sheet and paperboards; the cover sheet is divided into a bigger section and a smaller section, and the bigger section is then divided into three equal portions from inward to outward. Two paperboards are respectively adhered to the inward first and second portions. An opening is provided in the paperboard on the first portion. The outward third portion is counter-folded and adhered to the outer surface of the second paperboard. The second paperboard is counter-folded and with its outward margin adhered to the outward margin of the first paperboard. Consequently, a holder is formed for a picture or an ornamental card to be inserted into.

BRIEF DESCRIPTION OF THE DRAWINGS

Other features and advantages of the present invention will become apparent in the following detailed description of the preferred embodiments with reference to the accompanying drawings, in which:

FIG. 3 is a schematic view showing the position where the paperboards are adhered to and the manner how the cover sheet being counter-folded in the present invention;

FIG. 5 is a perspective view of a preferred embodiment of the front cover showing the position where an ornamental frame is provided in the present invention;

DETAILED DESCRIPTION OF THE PREFERRED EMBODIMENTS

Figure 1:
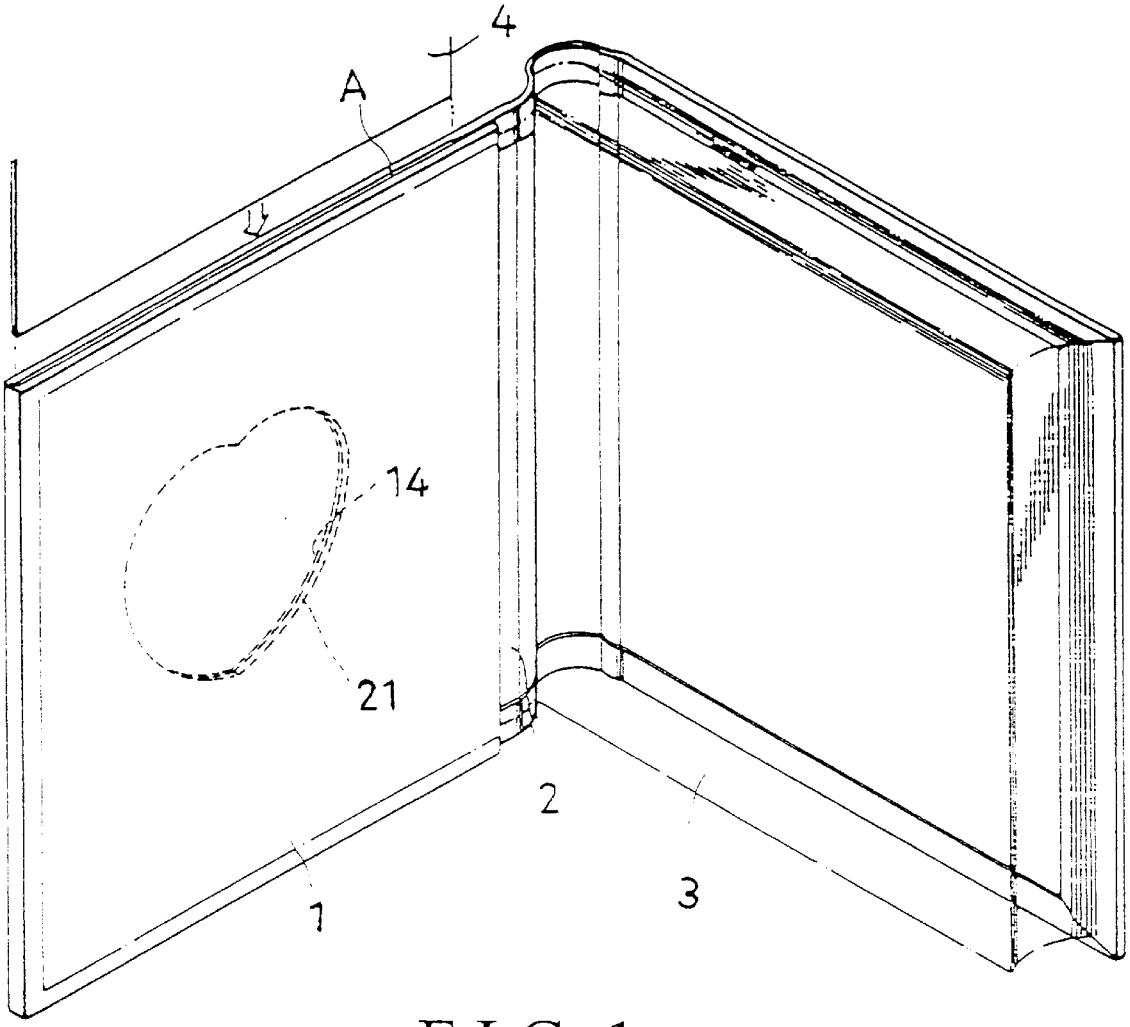
FIG. 1 is a perspective view of a front cover of a diary or notebook showing a preferred embodiment when bound with a plurality of inner pages in the present invention.

Referring to FIG. 1, a front cover of a diary or notebook in the present invention is integrated directly by a cover sheet 1, a first paperboard 2 and a second paperboard 2', and a plurality of inner pages 3.

Figure 2:
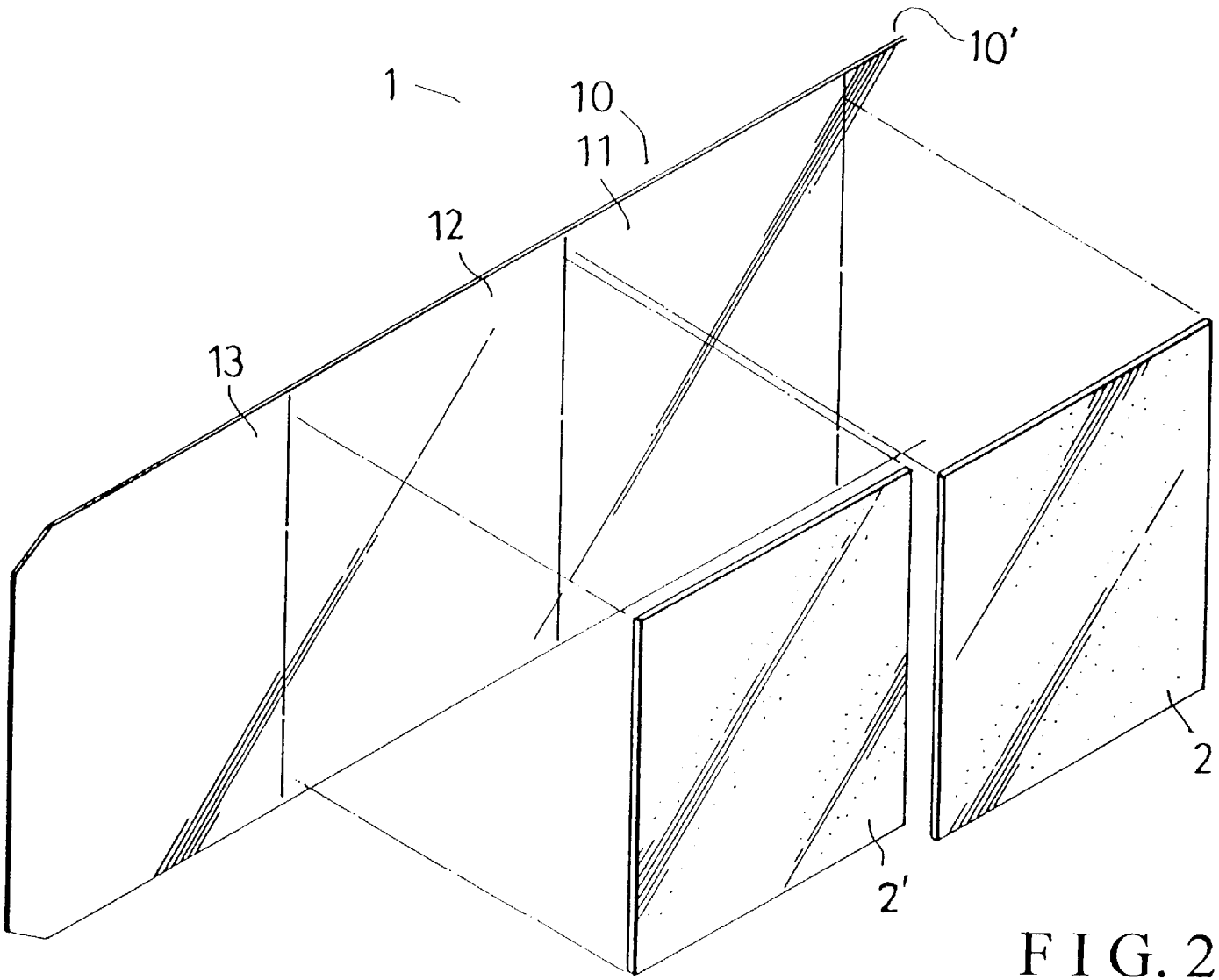
FIG. 2 is a schematic view showing the manner of paperboards adhered to the cover sheet in the present invention.
Figure 6:
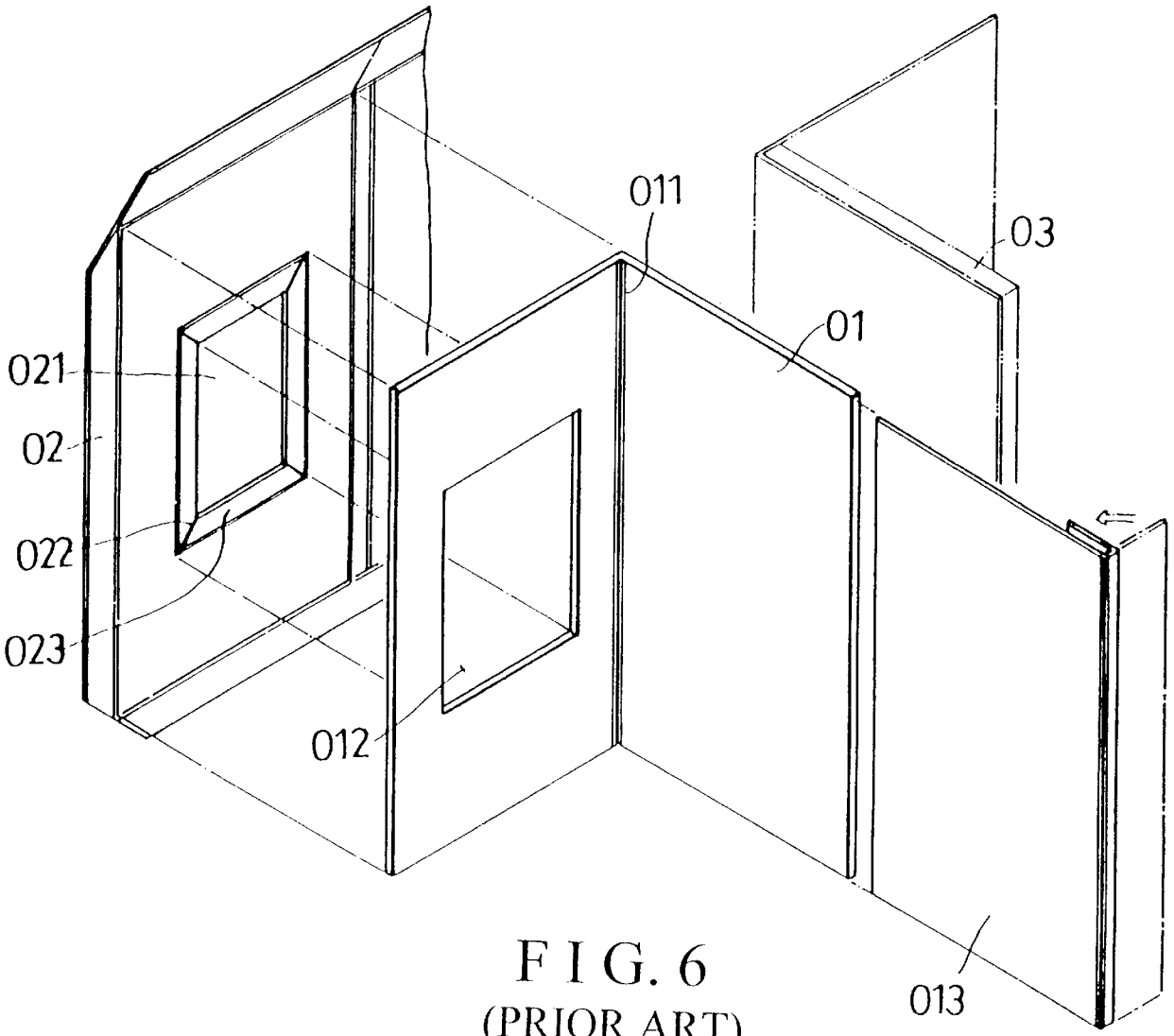
FIG. 6 (PRIOR ART)
FIG. 6 is an exploded perspective view of a conventional front cover.
Figure 8:
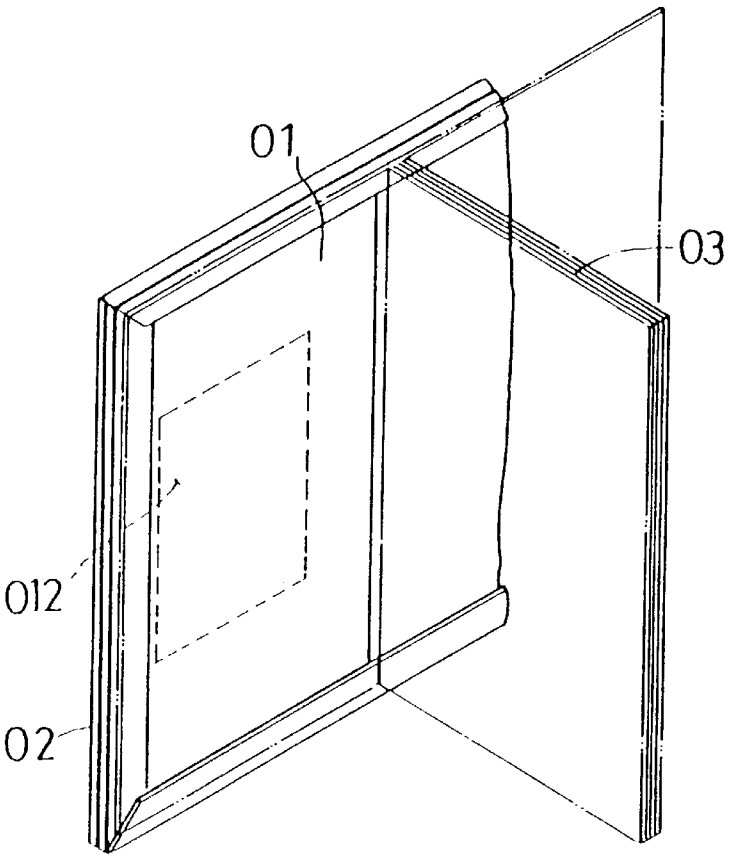
FIG. 8 (PRIOR ART)
Figure 7:
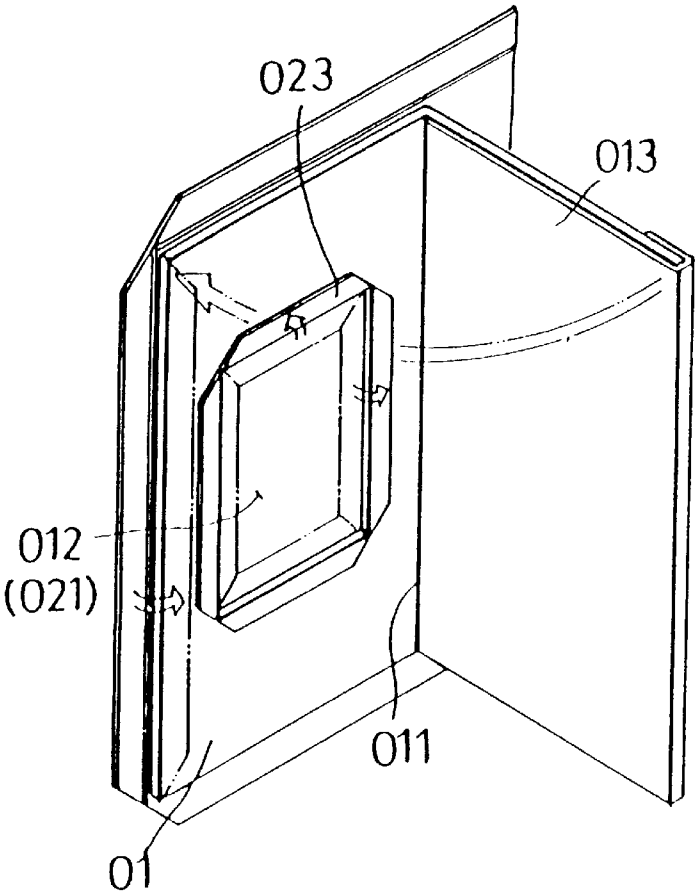
FIG. 7 (PRIOR ART)
FIG. 7 is a schematic view of a conventional front cover showing the manner how a paperboard and a cover sheet are composed; and, FIG. 8 is a schematic view of a conventional front cover when bound with a plurality of inner pages.

Referring to FIG. 2, the cover sheet 1, with predetermined size and having patterns on one surface, is first divided into a bigger section 10 and a smaller section 10' on the other surface; the bigger section 10 is used to form a front cover, and the smaller section 10' is used to form a back cover. Then, the bigger section 10 is divided into three equal portions 11,12 and 13 from inward to outward. The inward first and second equal portions 11 and 12 of the bigger section 10 of the cover sheet 1 are applied on glue respectively for the first paperboard 2 and the second paperboard 2' to be adhered to.

Referring to FIG. 3, overlapping openings 14 and 21 are simultaneously provided with a preferred shape, such as a circle, a square, etc., respectively in the proper positions of the first equal portion 11 and the first paperboard 2 which is adhered on the first equal portion 11. The outward third equal portion 13 without a paperboard is applied on glue and then counter-folded to adhere to the other surface of the second paperboard 2' adhered to the second equal portion 12; thus, the two surfaces of the second paperboard 2' is covered by the outer patterned surface of the cover sheet 1. The outward margin of the second paperboard 2' is applied on glue and then counter-folded to adhere firmly to the outward margin of the other surface of the first paperboard 2.

Figure 4:
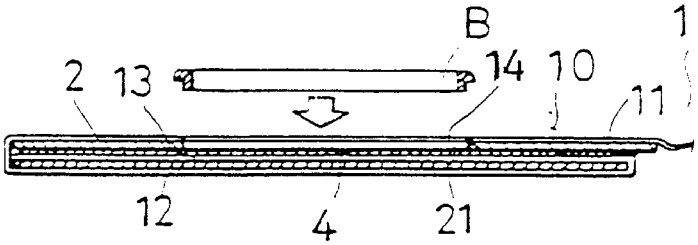
FIG. 4 is a cross-sectional view of the front cover showing the position where a picture or an ornamental card is inserted in the present invention.

Referring to FIG. 4 and FIG. 5, after the two outward margins of the first and second paperboards 2 and 2' are firmly adhered to each other, there is a holder A formed from the up to bottom portion without adhesion between the first and second paperboards 2 and 2'; consequently, a picture or an ornamental card 4 is able to be inserted into the holder A. An ornamental frame B with solid patterns is inlaid to surround the overlapping openings 14 and 21 so as to make the front cover look solid, lively and artistic. At last, a plurality of inner pages 3 may be bound between the front cover and the back cover, and thus a diary or notebook with a holder for a picture or an ornamental card to be inserted into is finished.

While the preferred embodiments of the invention have been described above, it will be recognized and understood that various modifications may be made therein and the appended claims are intended to cover all such modifications which may fall within the spirit and scope of the invention.

What is claimed is:

1. A front cover of a diary or notebook comprising:

a cover sheet having patterns on the outer surface and being previously sized, the inner surface of said cover sheet being divided into a bigger section and a smaller section, said bigger section used to form a front cover and said smaller section used to form a back cover, said bigger section being equally divided into a first portion, a second portion and a third portion from inward to outward;

a first paperboard and a second paperboard being respectively with one surface adhered to said first portion and said section portion, in proper positions of said first portion and said first paperboard being provided with two overlapping, shape-predetermined openings, said third portion without any paperboard being counter-folded to adhere to the other surface of said second paperboard on said second portion, the outward margin of the other surface of said second paperboard being applied on glue, then said second paperboard being counter-folded so as to adhere the outward margin of the other surface of said second paperboard firmly to the outward margin of the other surface of said first paperboard; and, a holder consequently being formed from the up to bottom portion without adhesion between said first paperboard and said second paperboard after said two outward margins being firmly adhered to each other, a picture or an ornamental card being able to be inserted into said holder.

2. A front cover of a diary or notebook as claimed in claim 1, wherein an ornamental frame with solid patterns being inlaid to surround said overlapping openings so as to make said front cover look solid, lively and artistic.

* * * * *